United States Patent [19]

Smith

[11] 4,290,004

[45] Sep. 15, 1981

[54] VOLTAGE REGULATOR CIRCUIT

[75] Inventor: Robert L. Smith, Indianapolis, Ind.

[73] Assignee: Emhart Industries, Inc., Indianapolis, Ind.

[21] Appl. No.: 118,558

[22] Filed: Feb. 4, 1980

[51] Int. Cl.[3] ..... G05F 3/08

[52] U.S. Cl. ..... 323/311; 323/315; 363/86; 307/55

[58] Field of Search ..... 307/55, 60; 323/4, 9, 323/22 T, 23, 39; 363/86

[56] References Cited

U.S. PATENT DOCUMENTS

| | | | |
|---|---|---|---|
| 2,992,385 | 7/1961 | Lingle | 323/23 X |
| 3,094,654 | 6/1963 | Roelli | 323/4 X |
| 3,214,668 | 10/1965 | Brinster | 323/22 Z X |
| 3,370,217 | 2/1968 | Tausig | 323/22 T X |

*Primary Examiner*—William M. Shoop

*Attorney, Agent, or Firm*—Robert F. Meyer; David W. Gomes

[57] ABSTRACT

A voltage regulator circuit of the type including a transistor having a base, an emitter representing a voltage output terminal and a collector representing a voltage input terminal, and a zener diode connected in series with the base to represent a common input-output terminal, wherein voltage regulation is achieved by the constant reverse bias voltage drop of the zener diode in combination with the constant forward bias voltage drop of the emitter-base junction of the transistor, the improvement including a second transistor having an emitter representing a second voltage output terminal with respect to the common input-output terminal, and the second transistor further having a base connected to the emitter of the first transistor, wherein voltage regulation is provided for the second output terminal with respect to the common input-output terminal by the combination of the voltage regulation provided at the first output terminal and the constant forward bias voltage drop of the emitter-base junction of the second transistor.

7 Claims, 1 Drawing Figure

VOLTAGE REGULATOR CIRCUIT

BACKGROUND OF THE INVENTION

1. Field of the Invention

Figure 1:
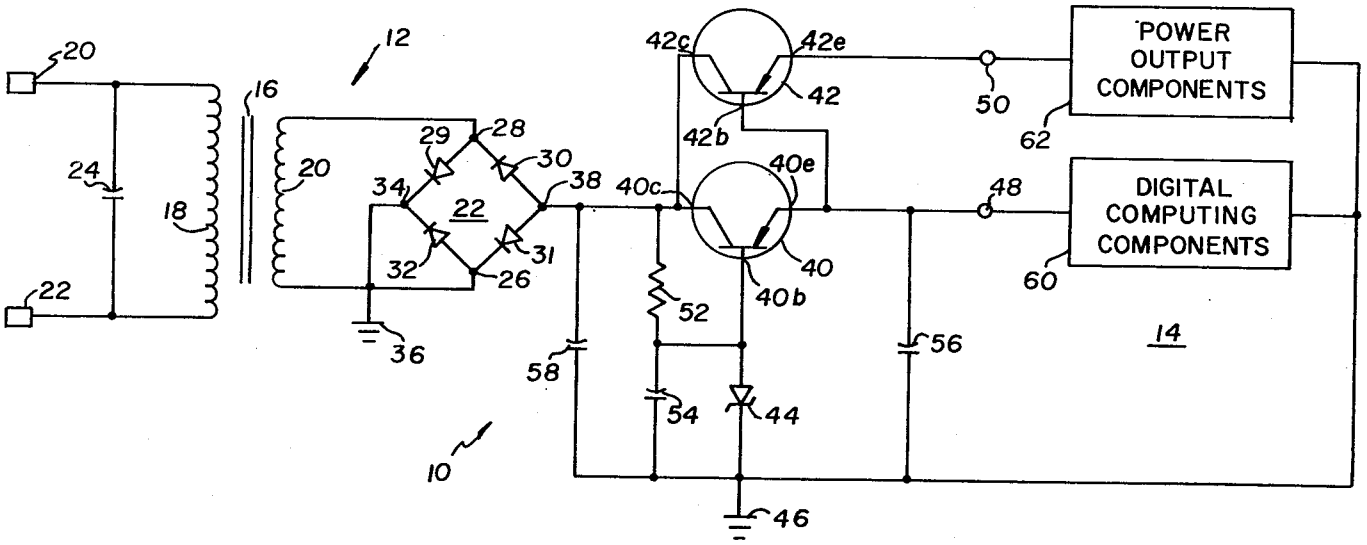

The present invention relates generally to voltage regulators and, in particular, to voltage regulator circuits providing a plurality of output terminals, which terminals are isolated from each other.

2. Statement Of The Prior Art

Voltage regulator circuits are used in a wide variety of electronic applications, including computers and, in particular, microcomputers. Voltage regulation is required for these applications to insure proper operation of the various components therein. It is often also desirable to isolate the power supplies of various components in order to prevent interference caused by the operation of one component from affecting the operation of another component. One specific example is the area of digital computing components which are often combined with a variety of output devices such as relays and triacs and other forms of output components having relatively large current requirements. It is often the case that interference is generated by output components and transmitted via the power supply wiring, which interference is capable of causing difficulties in the operation of various digital computing circuits, i.e. microcomputers and microprocessors. As a result of this, it is often required that such systems including both microcomputing components and high current output devices have a plurality of power supplies each of which has its own regulator for insuring proper operation of the various components. The use of a plurality of circuits to provide such a plurality of regulated outputs is more expensive than the use of a single regulated voltage power circuit.

SUMMARY OF THE INVENTION

The present invention provides a voltage regulator circuit of the type including a bipolar semiconductor device having a control terminal, a first main terminal representing a voltage output terminal and a second main terminal representing a voltage input terminal, and a voltage regulating device connected in series with the control terminal to represent a common input-output terminal, wherein voltage regulation is achieved by a constant voltage drop across the voltage regulating device in combination with a constant voltage drop across the junction of the control terminal and first main terminal of the bipolar semiconductor device, the improvement comprising: a second bipolar semiconductor device having a first main terminal representing a second voltage output terminal with respect to the common input-output terminal, and the second bipolar semiconductor device further having a control terminal connected to the first main terminal of the first semiconductor device, wherein voltage regulation is provided for the second output terminal with respect to the common input-output terminal by the combination of the voltage regulation provided at the first output terminal and a constant voltage drop across the junction of the control terminal and the first main terminal, both of the second semiconductor device. This invention is capable of providing a plurality of voltage outputs having isolation therebetween to prevent the components connected to one output from causing interference with the components connected to the other output and also provides for close tracking of the output voltage of the second output terminal to the output voltage of the first output terminal.

DISCUSSION OF THE DRAWING

Briefly, the FIGURE is a schematic diagram of a circuit constructed according to one embodiment of the present invention.

In reference to the FIGURE, a voltage regulation circuit 10 is shown in connection with a power supply circuit 12 and loading circuitry 14. The power supply circuit 12 includes a transformer 16 having a primary coil 18 connected to input terminals 20 and 22. A capacitor 24 having a very low capacitance value is connected in parallel with primary coil 18 for the purpose of bypassing high frequency noise present in the power line. The transformer 16 also includes a secondary coil 20 which usually represents a step down in voltage from the primary coil 18. A full-wave bridge rectifier 22 is connected to the secondary coil 20 at AC input terminals 26 and 28. The rectifier 22 is composed of diodes 29 through 32 and has one of its DC output terminals 34 connected to a ground 36. The rectifier 22 has another DC output terminal 38 which, according to the circuit arrangement produces a negative DC voltage with respect to the output terminal 34.

The terminal 38 is connected to the voltage regulating circuit 10, which includes as its main components, transistors 40 and 42 and a zener diode 44. The transistor 40 includes a base terminal **40*b* which is connected to the anode of zener diode 44. The cathode of zener diode 44 represents a common input-output terminal for the voltage regulator circuit 10, and in the present embodiment is connected to a ground 46. The transistor 40 also includes an emitter terminal 40*e* which represents an output of the regulating circuit and is connected to an output terminal 48. The transistor 40 also includes a collector terminal 40*c* which represents an input and is connected to the DC terminal 38 of rectifier 22. The transistor 42 includes a base terminal 42*b* which is connected to the emitter 40*e* and/or the output terminal 48. The transistor 42 also includes an emitter terminal 42*e* which represents a second output of the regulating circuit 10 and is connected to a second output terminal 50. The transistor 42 also includes a collector terminal 42*c* which in the present case is also connected to the DC voltage terminal 38 of rectifier 22**.

The regulating circuit 10 also includes a resistor 52 connected between the collector **40*c* and the base 40*b* of transistor 40 for the purpose of providing a path for current through the zener diode 44 to maintain that diode in its voltage regulation range. Capacitors 54 and 56 are connected in parallel with the zener diode 44 and between the first output terminal 48 and the common input-output terminal 46, respectively, for the purpose of filtering noise. An additional capacitor 58 is connected from the DC terminal 38 to the ground 46 as a means of filtering the rectified alternating current signal eminating from the terminal 38 into something more resembling a simple DC signal. It should be noted that the grounds 36 and 46 represent the same ground and that current will necessarily flow between them. It is contemplated that the functions of the transistors 40 and 42 might be replaced by some other suitable form of bipolar semiconductor device having a control terminal and main current carrying terminals in the same way that the transistors 40 and 42 include a base, emitter and collector. It is also contemplated that the present invention may be practiced by replacing the zener diode 44** with some other voltage regulating circuit or device.

The FIGURE also includes a representational showing of output loads in the loading circuitry 14. These loads are shown to include a package of digital computing components 60 which is intended to include such devices as microcomputers, microprocessors and other digital computing circuits normally associated therewith. The power output components package 62 is intended to include such components as power inverters or digital amplifiers normally used for driving various output components such as triacs and relay coils in response to signals from the digital computing components included in the package 60. As shown, the package 60 of digital computing component is connected to the output terminal 48 on one side and the ground 46 on the other. The package 62 of power output components is shown connected to the output terminal 50 on one side and the ground 46 on the other.

According to the present invention, the circuit shown in the FIGURE operates with several valuable advantages. Voltage regulation is normally achieved at the first output terminal 48 by the constant reversed biased voltage drop across the zener diode 44 and the constant base to emitter voltage drop of the transistor 40. Voltage regulation is provided at the second output terminal 50 by the combination of the voltage regulation provided at terminal 48 with the constant forward bias voltage drop across the base to emitter junction of transistor 42. By this arrangement, the voltage at output terminal 50 is made to closely track the voltage produced at terminal 48, being separated therefrom by only the constant forward bias voltage drop of the base-emitter junction of transistor 42. This tracking is produced regardless of various load changes and line variations which may occur. Further, the output voltage at terminal 48 is isolated from any of the various interference signals which may appear at the terminal 50. Such interference signals are a common occurrence in power supply lines which power output components because of their higher current demands and switching characteristics. Thus, sensitive digital computing components are protected from variations in their performance which would otherwise be induced by interference on their supply line. With the performance of this isolation function, the tracking function of the regulating circuit 10 deserves added emphasis. It is important that the voltages powering the power output components and the digital computing components remain within a certain tolerance of each other to prevent variations between the output signals of the computing components and the power supply of the power output components which would detrimentally influence the operation of the power output components. In other words, the voltage levels of the various outputs of the digital computing components is directly affected by the power voltage supplied to those components. If the voltage levels of these output signals vary too greatly from the power supply of the power output components, the performance of the power output components may be adversely affected. Thus, where separate regulating circuits are used to power digital computing components and power output components, special care must be taken to provide that the output voltages of the different regulating circuits track each other sufficiently closely to prevent the adverse operating characteristics of the power output components. This is usually done by improving the quality of the voltage regulation circuits at the cost of a greater number of and more expensive low tolerance, matched components and a higher power consumption for the regulation circuits. By the present invention, this isolation and tracking may be produced by firstly, a simple voltage regulation circuit and secondly, by a single voltage regulation circuit. Thus, savings are produced by the present invention in terms of the number of components used, the complexity of the circuitry, the quality of the components used and the power consumed by the regulating circuitry. For one example of an application of the present voltage regulating circuit see U.S. patent application of Robert L. Smith and M. B. Mozingo for METHOD AND SYSTEM FOR CONTROLLING AN APPARATUS, filed of even date herewith.

The above description of the present invention in reference to the appended drawing is intended to be illustrative and not to be taken in a limiting sense. Various modifications and changes may be made to the present embodiment by persons skilled in the art without departing from the scope of the appended claims.

What is claimed is:

1. In an electronic system of the type including a power supply means, first component means powered by said power supply means, which first component means by their nature transmit interference signals to said power supply means, second component means powered by said power supply means, said second component means being adversely sensitive to said interference signals, wherein the improvement includes a voltage regulator circuit comprising:

a first bipolar semiconductor device having a control terminal, a first main terminal representing a first output terminal for supplying power to said second component means and a second main terminal coupled to said power supply means;

a voltage regulating device connected in series with said control terminal of first said semiconductor device and representing a common input-output terminal between said power supply means and said first and second component means; and a second bipolar semiconductor device having a control terminal connected to said first main terminal of said first semiconductor device, a first main terminal representing a second output terminal with respect to said common input-output terminal for supplying power to first said component means and a second main terminal coupled to said power supply means, wherein voltage regulation is provided at said first output terminal by a constant voltage drop across said voltage regulating device in combination with a constant voltage drop between said control terminal and said first main terminal of said first semiconductor device, further wherein voltage regulation is provided at said second output terminal by the regulation provided at said first output terminal in combination with a constant voltage drop between said control terminal and said first main terminal of said second semiconductor device, and further wherein said interference signals of said first component means are isolated from reaching said second component means.

2. In a voltage regulator circuit of the type including a transistor having a base terminal, an emitter representing a voltage output terminal and a collector representing a voltage input terminal, and a zener diode connected in series with said base terminal to represent a common input-output terminal, wherein voltage regulation is achieved by the constant reverse bias voltage drop of said zener diode in combination with the constant forward bias voltage drop of the emitter-base junction of said transistor, the improvement comprising; a second transistor having an emitter representing a second voltage output terminal with respect to said common input-output terminal, and said second transistor further having a base connected to the emitter of first said transistor, wherein voltage regulation is provided for said second output terminal with respect to said common input-output terminal by the combination of the voltage regulation provided at first said output terminal and the constant forward bias voltage drop of the emitter-base junction of said second transistor.

3. The voltage regulator of claim 2, wherein said second transistor has a collector terminal connected to said collector terminal of first said transistor.

4. In a voltage regulator circuit of the type having a plurality of isolated output terminals for providing regulated voltages to different components of an electronic circuit and preventing interference signals generated by the components supplied by one terminal from interferring with the voltage supplied to components by the other terminal, the improvement comprising:

a first bipolar semiconductor device having a control terminal, a first main terminal representing a first output terminal and a second main terminal representing an input terminal;

a voltage regulating device connected in series with said control terminal of first said semiconductor device and representing a common input-output terminal; and a second bipolar semiconductor device having a control terminal connected to said first main terminal of said first semiconductor device, a first main terminal representing a second output terminal with respect to said common input-output terminal and a second main terminal representing a second input terminal with respect to said common input-output terminal, wherein voltage regulation is provided at said first output terminal by a constant voltage drop across said voltage regulating device in combination with a constant voltage drop between said control terminal of said first semiconductor device and said first main terminal of said first semiconductor device, further wherein voltage regulation is provided at said second output terminal by the regulation provided at said first output terminal in combination with a constant voltage drop between said control terminal of said second semiconductor device and said first main terminal of said second semiconductor device and said voltage at said second output terminal is caused to track the voltage at said first output terminal by reason of the constant voltage drop between said control and first main terminals of said second semiconductor device, and further wherein voltage variations present at said second output terminal are isolated from affecting the voltage at said first output terminal.

5. The voltage regulator circuit of claim 4, wherein said second semiconductor device is a transistor having an emitter connected as said first main terminal thereof, a base connected as said control terminal thereof and a collector connected as said second main terminal thereof.

6. The voltage regulator circuit of claim 5, wherein said first semiconductor device is a second transistor having an emitter connected as said first main terminal thereof, a base connected as said control terminal thereof and a collector connected as said second main terminal thereof.

7. The voltage regulator circuit of claim 6, wherein said voltage regulating device is a zener diode.

* * * * *